US009365806B2

(12) United States Patent
Carswell et al.

(10) Patent No.: US 9,365,806 B2
(45) Date of Patent: Jun. 14, 2016

(54) ALKALINE LIQUID LAUNDRY DETERGENT COMPOSITIONS COMPRISING POLYESTERS

(71) Applicant: Conopco Inc., Englewood Cliffs, NJ (US)

(72) Inventors: Robert John Carswell, Irby (GB); Dirk Fischer, Klein-Winternheim (DE); Thomas Lindner, Wiesbaden (DE); Alyn James Parry, Neston (GB); John Francis Wells, Neston (GB)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 14/417,410

(22) PCT Filed: Jul. 24, 2013

(86) PCT No.: PCT/EP2013/065583

§ 371 (c)(1),
(2) Date: Jan. 26, 2015

(87) PCT Pub. No.: WO2014/019903

PCT Pub. Date: Feb. 6, 2014

(65) Prior Publication Data

US 2015/0210961 A1 Jul. 30, 2015

(30) Foreign Application Priority Data

Jul. 31, 2012 (EP) ..... 12178621

(51) Int. Cl.

| | |
|---|---|
| ***C11D 1/00*** | (2006.01) |
| ***C11D 3/26*** | (2006.01) |
| ***C11D 3/30*** | (2006.01) |
| ***C11D 3/37*** | (2006.01) |
| ***C11D 1/14*** | (2006.01) |
| ***C11D 11/00*** | (2006.01) |

(52) U.S. Cl.

CPC ..... *C11D 3/3715* (2013.01); *C11D 1/146* (2013.01); *C11D 3/30* (2013.01); *C11D 3/3723* (2013.01); *C11D 11/0017* (2013.01)

(58) Field of Classification Search

CPC ..... C11D 1/00; C11D 3/26; C11D 3/30; C11D 3/3715

See application file for complete search history.

(56) References Cited

U.S. PATENT DOCUMENTS

| | | | |
|---|---|---|---|
| 4,759,876 | A | 7/1988 | Crossin |
| 6,153,723 | A | 11/2000 | Lang |
| 2009/0036641 | A1 | 2/2009 | Lang |
| 2010/0098655 | A1 | 4/2010 | Lang |

FOREIGN PATENT DOCUMENTS

| | | | | |
|---|---|---|---|---|
| DE | 102007005532 | | 8/2008 | |
| DE | 102007013217 | | 9/2008 | |
| EP | 0523956 | | 1/1993 | |
| EP | 0964015 | | 12/1999 | |
| EP | 1661933 | | 5/2006 | |
| EP | 2135931 | | 12/2009 | |
| EP | 2692842 | | 2/2014 | |
| GB | 1466639 | A | 3/1977 | |
| WO | WO2007079850 | | 7/2007 | |
| WO | WO2009153184 | | 12/2009 | |
| WO | WO 2012/104159 | * | 8/2012 | ..... C08G 63/66 |
| WO | WO2012104159 | A1 | 8/2012 | |
| WO | WO2014019792 | | 2/2014 | |

OTHER PUBLICATIONS

Search Report in EP12178620 dated Nov. 21, 2012, pp. 1-2.
IPRP2 in PCTEP2013065583 dated Jul. 17, 2014, pp. 3-18.
Search Report in EP12178621 dated Dec. 12, 2012, pp. 19-20.
Search Report in PCTEP2013063967 dated Sep. 17, 2013, pp. 21-23.
Search Report in PCTEP2013065583 dated Nov. 12, 2013, pp. 24-26.
Written Opinion in EP12178620 dated Nov. 21, 2012, pp. 27-28.
Written Opinion in EP12178621 dated Dec. 21, 2012, pp. 29-31.
Written Opinion in PCTEP2013065583 dated Nov. 12, 2013, pp. 32-36.
Written Opinion in PCTEP2013063967 dated Sep. 17, 2013, pp. 37-41.

* cited by examiner

*Primary Examiner* — Brian P Mruk
(74) *Attorney, Agent, or Firm* — Greenberg Traurig, LLP

(57) ABSTRACT

An alkaline liquid laundry detergent composition comprising at least 1 wt % triethanolamine, at least 5 wt % non-soap surfactant and at least 0.5 wt % of a polyester according to the following formula (I) wherein R1 and R2 independently of one another are X—(OC2H4)n-(OC3H6)m wherein X is $C_{1-4}$ alkyl, the —(OC2H4) groups and the —(OC3H6) groups are arranged blockwise and the block consisting of the —(OC3H6) groups is bound to a COO group or are HO—(C3H6), n is based on a molar average a number of from 12 to 120, preferably 40 to 50, m is based on a molar average a number of from 1 to 10, and a is based on a molar average a number of from 4 to 9. The inventive compositions comprise polyesters that have an advantageous stability in their alkaline environment and also possess advantageous soil release properties.

(I)

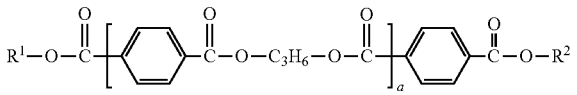

18 Claims, No Drawings

ALKALINE LIQUID LAUNDRY DETERGENT COMPOSITIONS COMPRISING POLYESTERS

TECHNICAL FIELD

This invention relates to alkaline liquid laundry detergent compositions comprising polyesters useful as soil release agents in the compositions.

BACKGROUND

Laundry detergent compositions containing polyesters have been widely disclosed in the art.

DE 10 2007 013 217 A1 and WO 2007/079850 A1 disclose anionic polyesters that may be used as soil release components in washing and cleaning compositions.

DE 10 2007 005 532 A1 describes aqueous formulations of soil release oligo- and polyesters with a low viscosity. The aqueous formulations may for example be used in washing and cleaning compositions.

EP 0 964 015 A1 discloses soil release oligoesters that may be used as soil release polymers in detergents and that are prepared using polyols comprising 3 to 6 hydroxyl groups.

EP 1 661 933 A1 is directed to at room temperature flowable, amphiphilic and nonionic oligoesters prepared by reacting dicarboxylic acid compounds, polyol compounds and water-soluble alkylene oxide adducts and their use as additive in washing and cleaning compositions. The primary focus of this document is on higher stability polymers and higher compatibility polymers for liquids. The performance of the polymers compared to the then state of the art for polyester soil release polymers is not derivable from this document. The performance data even for the fresh polymer (oligoester) is not very impressive because it was apparently not used as would be conventional for a soil release polymer on a fabric prewashed in the same composition. Thus the skilled worker can derive little information about the likely practical in wash performance benefit of the claimed oligoesters However, many of the polyesters described in the prior art are in need of improved stability in an alkaline environment, particularly when triethanolamine is also present. This material is useful to neutralise anionic surfactants for use in alkaline compositions, especially linear alkyl benzene sulphonate. Triethanolamaine also catalyses the alkaline hydrolysis of many polyesters otherwise suitable for use in detergents thereby losing soil release power. Furthermore, especially in alkaline heavy duty washing liquids polyesters often show turbidity upon incorporation.

GB 1 466 639 describes heavy duty liquid detergent compositions containing nonionic surfactants, ethanolamine-neutralized anionic surfactants, free ethanolamines and a polymeric soil release agent. The nonionic surfactant should be present in excess over the anionic to boost oily soil removal. At column 6 lines 2 to 5 it is pointed out that soil release polymers of the type claimed deposit under rinse conditions. In the test protocol the composition is applied via an unspecified prewash process. It appears that the "prewash" is needed to get the effect (polyester prewashed with the polymer containing compositions outperform those prewashed with the same composition without the polymer). It is common general knowledge that these early types of soil release polymer did not deposit well during the wash. As a result they were not commercially useful. GB 1 4 66 639 also explains that the compositions comprising the polymers were storage stable with triethanolamine. At several places it also states that they were equally storage stable with or amines etc; for example at Column 9 lines 36 to 43. This is not surprising because in contrast to the polymers with polyethoxylated end modifications described in the already discussed prior art this earlier type of polymers with the polyethoxylation embedded inside the polymer midblock rather than being at the end(s) does not fall apart to make non functional polymers if hydrolysed. Thus, the polymers in GB 1 466 639 can be viewed as compromising performance but having greater stability than the more recent polyester based soil release polymers developed mainly for powders applications. Starting from this prior art the skilled person does not require a more stable polymer. Instead, they must seek a higher performing polymer.

Therefore, it was the object of the present invention to provide compositions comprising triethanolamine in combination with selected new polyesters which have an advantageous stability in alkaline environment, possess a beneficial solubility and advantageously are clearly soluble in alkaline compositions such as alkaline heavy duty washing liquids and also possess advantageous soil release properties.

SUMMARY OF THE INVENTION

According to the present invention there is provided an alkaline liquid laundry detergent composition comprising at least 1 wt % triethanolamine, at least 5 wt % non-soap surfactant and at least 0.5 wt % of a polyester according to the following formula (I)

(I)

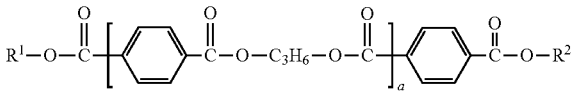

wherein

R1 and R2 independently of one another are X—(OC2H4)n-(OC3H6)m wherein X is $C_{1-4}$ alkyl, the —(OC2H4) groups and the —(OC3H6) groups are arranged blockwise and the block consisting of the —(OC3H6) groups is bound to a COO group or are HO—(C3H6), n is based on a molar average a number of from 12 to 120, preferably 40 to 50, m is based on a molar average a number of from 1 to 10, and a is based on a molar average a number of from 4 to 9.

Preferably the composition further includes at least 2 wt % nonionic alkoxylated polyethyleneimine with at least 3 moles of alkoxylation per nitrogen.

X is preferably methyl.

The compositions are especially useful as concentrated liquid laundry detergent compositions.

Preferably the alkaline detergent liquid composition is isotropic. The composition may comprise at least 5 wt % non-soap anionic surfactant. Suitably the liquid may comprise linear alkyl benzene sulphonate (LAS), Alkyl ether sulphate (AES), Nonionic and optionally an amine oxide or betaine, the LAS being formed from LAS acid, neutralized at least in part, with TEA. Amines may also be used as the counter ion for the AES. It is preferred for stability reasons to keep the total level of alkali metal ions less than 1 wt % of the composition.

To maximise the benefit of the other cleaning technologies that are essentially or optionally included in the liquid, especially anionic surfactant, the liquid is alkaline. It is preferred that the maximum concentrated composition pH is 8.4, more preferably at most 8.2.

The term "soil release agent" is applied to materials that modify the fabric surface minimizing the subsequent soiling and making the cleaning of the fabric easier on further washing cycles.

DETAILED DESCRIPTION OF THE INVENTION

The Polyester

With reference to formula (I):

The variable "a" based on a molar average preferably is a number of from 5 to 8 and more preferably is a number of from 6 to 7.

The variable "m" based on a molar average preferably is a number of from 2 to 5.

The variable "n" based on a molar average preferably is a number of from 43 to 47, more preferably is a number of from 44 to 46 and even more preferably is 45.

In one particularly preferred embodiment of the invention the composition comprises polyesters according to the following formula (I)

(I)

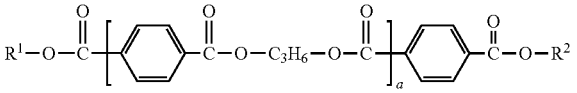

wherein

R1 and R2 independently of one another are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average a number of from 44 to 46, m is based on a molar average 2, and a is based on a molar average a number of from 5 to 8.

Among these polyesters the polyesters according to formula (I)

(I)

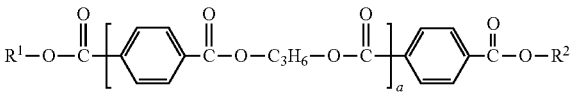

wherein

R1 and R2 independently of one another are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average 45, m is based on a molar average 2, and a is based on a molar average a number of from 6 to 7 are especially preferred.

In another particularly preferred embodiment of the invention the inventive compositions comprise polyesters according to the following formula (I)

(I)

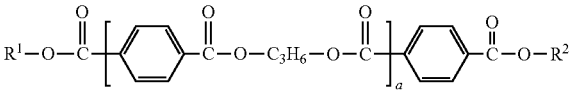

wherein

R1 and R2 independently of one another are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average a number of from 44 to 46, m is based on a molar average 5, and a is based on a molar average a number of from 5 to 8.

Among these polyesters the polyesters according to formula (I)

(I)

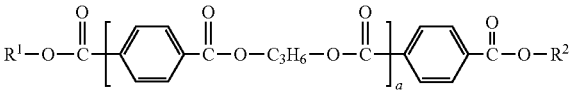

wherein

R1 and R2 independently of one another are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average 45, m is based on a molar average 5, and a is based on a molar average a number of from 6 to 7 are especially preferred.

The groups —O—C2H4- in the structural units "H3C—(OC2H4)n-(OC3H6)m" are of the formula —O—CH2-CH2-.

The groups —O—C3H6- in the structural units indexed with "a", in the structural units "H3C—(OC2H4)n-(OC3H6)m" and in the structural units HO—(C3H6) are of the formula —O—CH(CH3)-CH2- or —O—CH2-CH(CH3)-, i.e. are of the formula

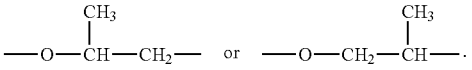

The polyesters may advantageously be prepared by a process which comprises heating dimethyl terephthalate (DMT), 1,2-propylene glycol (PG), and H3C—(OC2H4)n-(OC3H6)m-OH, wherein the —(OC2H4) groups and the —(OC3H6) groups are arranged blockwise and the block consisting of the —(OC3H6) groups is bound to the hydroxyl group —OH and n and m are as defined in formula (I), with the addition of a catalyst, to temperatures of from 160 to 220° C., firstly at atmospheric pressure, and then continuing the reaction under reduced pressure at temperatures of from 160 to 240° C.

A suitable process for the preparation of the polyesters comprises heating dimethyl terephthalate (DMT), 1,2-propylene glycol (PG), and H3C—(OC2H4)n-(OC3H6)m-OH, wherein the —(OC2H4) groups and the —(OC3H6) groups are arranged blockwise and the block consisting of the —(OC3H6) groups is bound to the hydroxyl group —OH and n and m are as defined in formula (I), with the addition of a catalyst, to temperatures of from 160 to 220° C., firstly at atmospheric pressure, and then continuing the reaction under reduced pressure at temperatures of from 160 to 240° C.

Reduced pressure preferably means a pressure of from 0.1 to 900 mbar and more preferably a pressure of from 0.5 to 500 mbar.

A preferred process is characterized in that a) dimethyl terephthalate, 1,2-propylene glycol, H3C—(OC2H4)n-(OC3H6)m-OH and a catalyst are added to a reaction vessel, heated under inert gas, preferably nitrogen, to a temperature of from 160° C. to 220° C. to remove methanol and then pressure is reduced to below atmospheric pressure, preferably to a pressure of from 200 to 900 mbar and more preferably to a pressure of from 400 to 600 mbar for completion of the transesterification, and b) in a second step the reaction is continued at a temperature of from 210° C. to 240° C. and at a pressure of from 0.1 to 10 mbar and preferably of from 0.5 to 5 mbar to form the polyester.

Sodium acetate (NaOAc) and tetraisopropyl orthotitanate (IPT) is preferably used as the catalyst system in the process.

Unless explicitly stated otherwise, all percentages given are percentages by weight (% by wt. or wt.-%).

General Procedure for the Preparation of the Polyesters

The polyester synthesis is carried out by the reaction of dimethyl terephthalate (DMT), 1,2-propylene glycol (PG), and methyl polyalkyleneglycol using sodium acetate (NaOAc) and tetraisopropyl orthotitanate (IPT) as the catalyst system. The synthesis is a two-step procedure. The first step is a transesterification and the second step is a polycondensation.

Transesterification

Dimethyl terephthalate (DMT), 1,2-propylene glycol (PG), methyl polyalkyleneglycol, sodium acetate (anhydrous) (NaOAc) and tetraisopropyl orthotitanate (IPT) are weighed into a reaction vessel at room temperature.

For the melting process and homogenization, the mixture is heated up to 170° C. for 1 h and then up to 210° C. for a further 1 h sparged by a nitrogen stream. During the transesterification methanol is released from the reaction and is distilled out of the system (distillation temperature <55° C.). After 2 h at 210° C. nitrogen is switched off and the pressure is reduced to 400 mbar over 3 h.

Polycondensation

The mixture is heated up to 230° C. At 230° C. the pressure is reduced to 1 mbar over 160 min. Once the polycondensation reaction has started, 1,2-propylene glycol is distilled out of the system. The mixture is stirred for 4 h at 230° C. and a pressure of 1 mbar. The reaction mixture is cooled down to 140-150° C. Vacuum is released with nitrogen and the molten Polymer is transferred into a glass bottle.

Detergent Compositions

In addition to the essential ingredients as claimed the detergent compositions may comprise one or more optional ingredients, e.g. they may comprise conventional ingredients commonly used in detergent compositions, especially laundry detergent compositions. Examples of optional ingredients include, but are not limited to builders, bleaching agents, bleach active compounds, bleach activators, bleach catalysts, photobleaches, dye transfer inhibitors, colour protection agents, anti-redeposition agents, dispersing agents, fabric softening and antistatic agents, fluorescent whitening agents, enzymes, enzyme stabilizing agents, foam regulators, defoamers, malodour reducers, preservatives, disinfecting agents, hydrotropes, fibre lubricants, anti-shrinkage agents, buffers, fragrances, processing aids, colorants, dyes, pigments, anti-corrosion agents, fillers, stabilizers and other conventional ingredients for washing or laundry detergent compositions.

The compositions according to the invention comprising the polyesters of formula (I) have an advantageous stability in alkaline environment, possess a beneficial solubility and advantageously are clearly soluble in alkaline compositions such as heavy duty washing liquids and also possess advantageous soil release properties. In washing or laundry detergent compositions they result in a beneficial washing performance, in particular also after storage. Furthermore, the polyesters possess advantageous foam suppressing properties. This is not only advantageous when the washing or laundry detergent compositions comprising the polyesters of formula (I) are applied but also advantageously reduces foaming during handling of the compositions.

Surfactants

Surfactants assist in removing soil from the textile materials and also assist in maintaining removed soil in solution or suspension in the wash liquor. Anionic or blends of anionic and nonionic surfactants are a preferred feature of the present invention. The amount of anionic surfactant is preferably at least 5 wt %. It is preferred that the ratio of nonionic surfactant to total surfactant is at most 3:2.

Anionic

Preferred alkyl sulphonates are alkylbenzene sulphonates, particularly linear alkylbenzene sulphonates having an alkyl chain length of $C_8$-$C_{15}$. The preferred counter ion for concentrated alkaline liquids is one or more ethanolamines, for example monoethanolamine (MEA) and triethanolamine (TEA). This introduces TEA into the composition.

The linear alkyl benzene sulphonate surfactants may be Detal LAS with an alkyl chain length of from 8 to 15, more preferably 12 to 14.

It is further desirable that the composition comprises an alkyl polyethoxylate sulphate anionic surfactant of the formula (II):

$$RO(C_2H_4O)_ySO_3^-M^+ \quad (II)$$

where R is an alkyl chain having from 10 to 22 carbon atoms, saturated or unsaturated, M is a cation which makes the compound water-soluble, especially an ammonium or substituted ammonium cation, or less preferably an alkali metal, and y averages from 1 to 15.

Preferably R is an alkyl chain having from 12 to 16 carbon atoms, y averages from 1 to 3, preferably y is 3; M may be an ethanolamine, or other material chosen from the list of buffers, to avoid ion exchange of sodium with the counter ion of the LAS. However, since some sodium can be tolerated the counter ion can be sodium if low levels of this surfactant are used. The anionic surfactant sodium lauryl ether sulphate (SLES) may be used provided total alkali metal salts in the composition remain low. An average of 3 moles of ethylene oxide per mole is preferred.

Nonionic

Nonionic surfactants include primary and secondary alcohol ethoxylates, especially $C_8$-$C_{20}$ aliphatic alcohol ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl polyglycosides, glycerol monoethers and polyhydroxy amides (glucamide). Mixtures of nonionic surfactant may be used. When included therein the composition contains from 0.2 wt % to 40 wt %, preferably 1 wt % to 20 wt %, more preferably 5 to 15 wt % of a non-ionic surfactant, such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides").

Nonionic surfactants that may be used include the primary and secondary alcohol ethoxylates, especially the $C_8$-$C_{20}$ aliphatic alcohols ethoxylated with an average of from 1 to 35 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

Amine Oxide

The composition may comprise up to 10 wt % of an amine oxide of the formula (III):

$$R^4N(O)(CH_2R^3)_2 \quad \text{(III)}$$

In which $R^4$ is a long chain moiety each $CH_2R^3$ are short chain moieties. $R^3$ is preferably selected from hydrogen, methyl and —$CH_2OH$. In general $R^4$ is a primary or branched hydrocarbyl moiety which can be saturated or unsaturated, preferably, $R^4$ is a primary alkyl moiety. $R^4$ is a hydrocarbyl moiety having chain length of from about 8 to about 18.

Preferred amine oxides have $R^4$ is $C_8$-$C_{18}$ alkyl, and $R^3$ is H. These amine oxides are illustrated by $C_{12-14}$ alkyldimethyl amine oxide, hexadecyl dimethylamine oxide, octadecylamine oxide.

A preferred amine oxide material is Lauryl dimethylamine oxide, also known as dodecyldimethylamine oxide or DDAO. Such an amine oxide material is commercially available from Huntsman under the trade name Empigen® OB. Amine oxides suitable for use herein are also available from Akzo Chemie and Ethyl Corp. See McCutcheon's compilation and Kirk-Othmer review article for alternate amine oxide manufacturers.

Whereas in certain of the preferred embodiments $R^4$ is H, it is possible to have $R^4$ slightly larger than H. Specifically, $R^4$ may be $CH_2OH$, for example: hexadecylbis(2-hydroxyethyl) amine oxide, tallowbis(2-hydroxyethyl)amine oxide, stearylbis(2-hydroxyethyl)amine oxide and oleylbis(2-hydroxyethyl)amine oxide. Preferred amine oxides have the formula:

$$O^-—N^+(Me)_2R^5 \quad \text{(IV)}$$

where $R^5$ is $C_{12-16}$ alkyl, preferably $C_{12-14}$ alkyl; Me is a methyl group.

Zwitterionic

Nonionic-free systems with up to 95% wt LAS can be used provided that some zwitterionic surfactant, such as carbobetaine, is present. A preferred zwitterionic material is a betaine available from Huntsman under the name Empigen® BB. Betaine improves particulate soil detergency in the compositions of the invention.

Additional Surfactants

Other surfactants than the preferred LAS, AES, and nonionic may be added to the mixture of detersive surfactants. However, cationic surfactants are preferably substantially absent.

Although less preferred, some alkyl sulphate surfactant (PAS) may be used, especially the non-ethoxylated $C_{12-15}$ primary and secondary alkyl sulphates. Soap may be used. Levels of soap are preferably lower than 5 wt %; more preferably lower than 3 wt % most preferably lower than 1 wt %.

EPEI

For detergency boosting it is advantageous to use a second polymer with the soil release polymers in the compositions of the present invention. This second polymer is preferably a polyalkoxylated polyethyleneimine. Polyethylene imines are materials composed of ethylene imine units —CH2CH2NH— and, where branched, the hydrogen on the nitrogen is replaced by another chain of ethylene imine units. These polyethyleneimines can be prepared, for example, by polymerizing ethyleneimine in the presence of a catalyst such as carbon dioxide, sodium bisulphite, sulphuric acid, hydrogen peroxide, hydrochloric acid, acetic acid, and the like. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951.

Preferably, the EPEI comprises a polyethyleneimine backbone of about 300 to about 10000 weight average molecular weight; and the polyalkoxylation comprises polyethoxylation. The polymer is nonionic and has no permanent quaternisation of the polyamine nitrogens; although they may be protonated depending on the pH. A preferred nonionic EPEI may be represented as PEI(X)YEO where X represents the molecular weight of the unmodified PEI and Y represents the average moles of ethoxylation per nitrogen atom in the polyethyleneimine backbone. The ethoxylation may range from 3 to 40 ethoxy moieties per polyalkoxyl chain, preferably it is in the range of 16 to 26, most preferably 18 to 22. A minority of the ethoxy units may be replaced by propoxy units.

When present the alkoxylated polyethyleneimine polymer is present in the composition at a level of between 0.01 and 25 wt %, and preferably at a level of at least 2 wt % and/or less than 9.5 wt %, most preferably from 3 to 9 wt % and with a ratio of non-soap surfactant to EPEI of from 2:1 to 7:1, preferably from 3:1 to 6:1, or even to 5:1.

Other Polymers

In addition to the polyester soil release polymer with antifoam properties and the optional EPEI the composition may comprise other polymeric materials, for example: dye transfer inhibition polymers, anti redeposition polymers and cotton soil release polymers, especially those based on modified cellulosic materials. Especially when EPEI is not present the composition may further comprise a polymer of polyethylene glycol and vinyl acetate, for example the lightly grafted copolymers described in WO2007/138054. Such amphiphilic graft polymers based on water soluble polyalkylene oxides as graft base and side chains formed by polymerisation of a vinyl ester component have the ability to enable reduction of surfactant levels whilst maintaining high levels of oily soil removal.

Hydrotrope

In the context of this invention a hydrotrope is a solvent that is neither water nor conventional surfactant that aids the solubilisation of the surfactants and other components, especially polymer and sequestrant, in the liquid to render it isotropic. Among suitable hydrotropes there may be mentioned as preferred: MPG (monopropylene glycol), glycerol, sodium cumene sulphonate, ethanol, other glycols, e.g. di propylene glycol, diethers and urea. MPG and glycerol are preferred hydrotropes.

Enzymes

It is preferable that at least one or more enzymes selected from protease, mannanase, pectate lyase, cutinase, esterase, lipase, amylase, and cellulase may be present in the compositions. Less preferred additional enzymes may be selected from peroxidase and oxidase. The enzymes are preferably present with corresponding enzyme stabilizers. The total enzyme content is preferably at least 2 wt %, even as high as at least 4 wt %.

Sequestrants

Sequestrants are preferably included. Preferred sequestrants include organic phosphonates, alkanehydroxy phosphonates and carboxylates available under the DEQUEST trade mark from Thermphos.

The preferred sequestrant level is less than 10 wt % and preferably less than 5 wt % of the composition. A particularly preferred sequestrant is HEDP (1-Hydroxyethylidene-1,1,-diphosphonic acid), for example sold as Dequest 2010. Also suitable but less preferred as it gives inferior cleaning results is Dequest® 2066 (Diethylenetriamine penta(methylene phosphonic acid or Heptasodium DTPMP).

Buffers

In addition to the 1% TEA the presence of buffer is preferred for pH control; preferred buffers are MEA, and TEA. They are preferably used in the composition at levels of from 5 to 15 wt %, including the 1% TEA. Other suitable buffer materials may be selected from the group consisting of amino alcohol compounds having a molecular weight above 61 g/mol, which includes MEA. Suitable materials also include, in addition to the already mentioned materials: monoisopropanolamine, diisopropanolamine, triisopropanolamine, monoamino hexanol, 2-[(2-methoxyethyl)methylamino]-ethanol, propanolamine, N-methylethanolamine, diethanolamine, monobutanolamine, isobutanolamine, monopentanolamine, 1-amino-3-(2-methoxyethoxy)-2-propanol, 2-methyl-4-(methylamino)-2-butanol and mixtures thereof.

Further Optional Ingredients:

It may be advantageous to include fluorescer and/or bleach catalyst in the compositions as further high efficiency performance additives. Their inclusion is also made easier by the soap reduction made possible by inclusion of the propoxylated polyester soil release polymers. Perfume and colorants will desirably be included in the compositions. The compositions may contain viscosity modifiers, foam boosting agents, preservatives (e.g. bactericides), pH buffering agents, polyelectrolytes, anti-shrinking agents, anti-wrinkle agents, anti-oxidants, sunscreens, anti-corrosion agents, drape imparting agents, anti-static agents and ironing aids. The compositions may further comprise, pearlisers and/or opacifiers or other visual cues and shading dye.

Packaging and Dosing

The liquids may be packaged as unit doses in polymeric film soluble in the wash water. Alternatively the liquids may be supplied in multidose plastics packs with a top or bottom closure. A dosing measure may be supplied with the pack either as a part of the cap or as an integrated system.

The invention will now be further described with reference to the following non-limiting examples.

EXAMPLES

Example I

| Amount [g] | Amount [mol] | Raw Material [Abbreviation] |
|---|---|---|
| 101.95 | 0.53 | DMT |
| 84.0 | 1.104 | PG |
| 343.5 | 0.15 | H3C—(OC2H4)45—(OC3H6)5—OH |
| 0.5 | 0.0061 | NaOAc |
| 0.2 | 0.0007 | IPT |

A suitable polyester according to formula (I) is obtained wherein

R1 and R2 are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average 45, m is based on a molar average 5, and a is based on a molar average a number of from 6 to 7.

Example II

| Amount [g] | Amount [mol] | Raw Material [Abbreviation] |
|---|---|---|
| 101.95 | 0.53 | DMT |
| 84.0 | 1.104 | PG |
| 317.4 | 0.15 | H3C—(OC2H4)45—(OC3H6)2—OH |
| 0.5 | 0.0061 | NaOAc |
| 0.2 | 0.0007 | IPT |

A suitable polyester according to formula (I) is obtained wherein

R1 and R2 are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average 45, m is based on a molar average 2, and a is based on a molar average a number of from 6 to 7.

Example III

Comparative Example

| Amount [g] | Amount [mol] | Raw Material [Abbreviation] |
|---|---|---|
| 44.7 | 0.23 | DMT |
| 38 | 0.50 | PG |
| 301.1 | 0.14 | H3C—(OC2H4)45—(OC3H6)2—OH |
| 0.5 | 0.0061 | NaOAc |
| 0.2 | 0.0007 | IPT |

A comparative polyester of formula (I') is obtained (I')

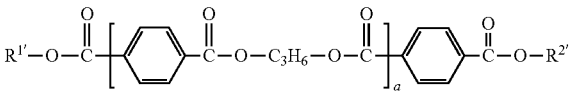

wherein

R1' and R2' are H3C—(OC2H4)n'—(OC3H6)m' wherein the —(OC2H4) groups and the —(OC3H6) groups are arranged blockwise and the block consisting of the —(OC3H6) groups is bound to a COO group, n' based on a molar average is 45, m' based on a molar average is 2, and a based on a molar average is from 2 to 3.

Example IV

Comparative Example

| Amount [g] | Amount [mol] | Raw Material [Abbreviation] |
|---|---|---|
| 101.95 | 0.53 | DMT |
| 84.0 | 1.1 | PG |
| 206.0 | 0.1 | H3C—(OC2H4)45—(OC3H6)2—OH |
| 0.5 | 0.0061 | NaOAc |
| 0.2 | 0.0007 | IPT |

A comparative polyester of formula (I') is obtained (I')

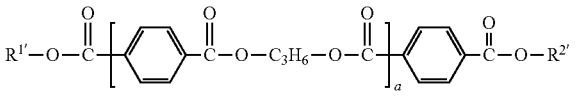

wherein

R1' and R2' are H3C—(OC2H4)n'—(OC3H6)m' wherein the —(OC2H4) groups and the —(OC3H6) groups are arranged blockwise and the block consisting of the —(OC3H6) groups is bound to a COO group, n' based on a molar average is 45, m' based on a molar average is 2, and a based on a molar average is a number of approximately 10.

Stability Test in Detergent Formulation 1 wt.-% (based on the total weight of the detergent formulation used) of the polyesters of Examples I to IV and of the commercially available soil release polymer "TexCare SRN100" was dissolved in a detergent test formulation (the composition of this detergent test formulation is given in Table 1 below) and the pH value was set with caustic to pH 8.2. The turbidity of the formulations was determined. The prepared formulations were stored at 60° C. for 8 days. Afterwards, the hydrolysis of the polyesters was determined and compared to the hydrolysis of the commercially available soil release polymer "TexCare SRN100" by GPC analysis. The results are given in Table 2 below.

TexCare SRN100 is a polyester comprising —OOC-(1,4-phenylene)-COO— structural units and —O—CH2CH2-O— structural units.

TABLE 1

Detergent test formulation

| | wt % |
|---|---|
| MPG | 15.00 |
| TEA | 4.18 |
| NI 7EO | 7.28 |
| LAS acid | 4.85 |
| SLES 3EO | 2.42 |
| Empigen BB | 0.86 |
| Prifac 5908 | 0.86 |
| EPEI | 3.14 |
| Perfume | 1.39 |
| Polymer | 1.00 |
| Demin water and NaOH to adjust to pH 8.2 | to 100 |

Key to ingredients used:

MPG is mono propylene glycol.

TEA is triethanolamine.

NI 7EO is C12-15 alcohol ethoxylate 7EO nonionic Neodol® 25-7 (ex Shell Chemicals).

LAS acid is C12-14 linear alkylbenzene sulphonic acid.

SLES 3EO is sodium lauryl ether sulphate with 3 moles EO.

Empigen® BB is Carbobetaine ex Huntsman.

Empigen® OB is amine oxide ex Huntsman.

Prifac® 5908 is saturated lauric fatty acid ex Croda.

Dequest® 2010 is HEDP (1-Hydroxyethlidene-1,1, diphosphonic acid) ex Thermphos.

EPEI is Sokalan HP20-ethoxylated polyethylene imine cleaning polymer: PEI(600) 20EO ex BASF.

Perfume is free oil perfume.

TexCare SRN-100 is soil release polymer ex Clariant.

TABLE 2

Turbidity of formulation comprising polyester and stability of polyester therein

| Polyester | Turbidity | Degree of Hydrolysis |
|---|---|---|
| TexCare SRN100 | clearly soluble | 100% |
| Example I (inventive) | clearly soluble | 45% |
| Example II (inventive) | clearly soluble | 48% |
| Example III (comparative) | clearly soluble | 72% |
| Example IV (comparative) | turbid | 42% |

%-values for polyesters of Examples I to IV in comparison/relation to TexCare SRN100.

Soil Release Test:

The polyesters of Examples I and II were tested for their soil release performance according to the "Dirty-Motor Oil" Test (DMO-Test).

The polyesters of Examples I and II were used in concentrations of 1 wt.-% (based on the total weight of the detergent formulation used) and the formulations were stored according to the stability test. The formulations were those described above for the stability test. As test fabric a white polyester standard fabric (30A) was used. The prewashed fabrics (the fabrics were prewashed with the stored detergent formulations comprising the polyesters of Examples I and II) were soiled with dirty motor oil. After 1 h the soiled fabrics were washed again with the stored detergent formulations comprising the polyesters of Examples I and II. The washing conditions for the "prewash" and for the washing procedure after soiling with dirty motor oil were as given in Table 3.

TABLE 3

Washing conditions

| Washing machine | Linitest |
|---|---|
| Hardness of water | 15° H |
| Washing temperature | 40° C. |
| Washing time | 30 min |
| Detergent concentration | 6 g/L |

The washing results obtained for the stored formulations comprising the polyesters of Examples I and II are shown in Table 4. Table 4 also shows the washing result obtained for a detergent formulation comprising 1 wt.-% of TexCare SRN100. The composition of this detergent formulation comprising TexCare SRN100 was as described above for the stability test. In case of TexCare SRN100 the conditions for the "prewash" and for the washing procedure after soiling were similar to the conditions used for the detergent formulations comprising the polyesters of Examples I and II but with the exception that in case of TexCare SRN100 the "prewash" and the washing procedure after the soiling of the fabrics with dirty motor oil was done using "fresh" detergent formulation (no alkaline storage).

TABLE 4

| Test results (washing performance) | | |
|---|---|---|
| Polyester | results for "fresh" formulation or after storage | Washing Performance |
| TexCare SRN100 | fresh | 100% |
| Example I | after storage | 96% |
| Example II | after storage | 107% |

Testing in a Further Detergent Composition

To verify that the soil release polymers were stable and gave good performance across a range of liquids the polymer of Example II was further tested in the concentrated laundry liquid composition given in Table 5. This composition is designed to be dosed at 20 ml per wash in typical European front loading automatic washing machine.

TABLE 5

| | wt % |
|---|---|
| MPG | 15.00 |
| TEA | 3.50 |
| MEA | 3.05 |
| NI 7EO | 12.74 |
| LAS acid | 8.49 |
| SLES 3EO | 4.24 |
| Empigen OB | 1.50 |
| Prifac 5908 | 0.75 |
| EPEI | 5.50 |
| Dequest 2010 | 2.50 |
| Preservative | 0.016 |
| Polymer (Example II) | 3.75 |
| Perfume | 1.39 |
| Demin water | to 100 |
| Measured product pH | 8.05 |

In this case, wash performance was assessed using tergotometer wash protocol. The details of which can be found in Table 6

TABLE 6

| Tergotometer Washing conditions | |
|---|---|
| Washing machine | Tergotometer |
| Hardness of water | 26° FH |
| Washing temperature | 25° C. |
| Washing time | 30 min |
| Detergent concentration | 1.3 g/L |

Three, clean knitted polyester monitor fabrics were used in each pot. In the two prewashes these were unstained. The appropriate liquor:cloth ratio of 25:1 was achieved using a mixture of 50% knitted polyester and 50% woven cotton. After the washing stage, two 1-minute rinses were performed and the ballast was discarded. After a second cycle of prewashing and drying, the monitor fabrics were then stained with dirty motor oil and allowed to dry before being washed for a final time to assess washing performance of the composition. Before and after washing, the colour of the stains was measured using a Hunterlab Ultrascan XE and expressed in terms of the difference between the stain and clean cloth giving ΔE*(before wash) or ΔE*(after wash) values respectively. The ΔE values being the colour differences defined as the Euclidian distance between the stain and clean cloth in L*a*b* colour space. The ΔE*(after wash) values were converted to Stain Removal Index (SRI) values by application of the standard transformation:

$$SRI=100-\Delta E^*(\text{after wash})$$

Using this composition, an average SRI value of 91.3 (s.d. 5.8) was obtained after storage at 60° C. for 8 days. If one was to compare this to the performance of fresh SRN100, as per our previous example, this would equate to a wash performance of around 91%.

The invention claimed is:

1. An alkaline liquid laundry detergent composition comprising at least 1 wt % triethanolamine, at least 5 wt % non-soap surfactant and at least 0.5 wt % of a polyester according to the following formula (I)

(I)

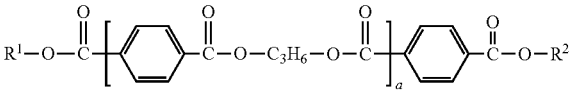

wherein

R1 and R2 independently of one another are X—(OC2H4)n-(OC3H6)m wherein X is $C_{1-4}$ alkyl, the —(OC2H4) groups and the —(OC3H6) groups are arranged blockwise and the block consisting of the —(OC3H6) groups is bound to a COO group, n is based on a molar average a number of from 43 to 47, m is based on a molar average a number of from 2 to 5, and a is based on a molar average a number of from 6 to 7.

2. Composition according to claim 1, characterized in that n based on a molar average is a number of from 44 to 46.

3. Composition according to claim 2, characterized in that n based on a molar average is 45.

4. Composition according to claim 1, characterized in that R1 and R2 independently of one another are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average a number of from 44 to 46, m is based on a molar average 2, and a is based on a molar average a number of from 6 to 7.

5. Composition according to claim 4, characterized in that n based on a molar average is 45.

6. Composition according to claim 1, characterized in that R1 and R2 independently of one another are H3C—(OC2H4)n-(OC3H6)m wherein the —(OC2H4) groups and the —(OC3H6) groups are arranged blockwise and the block consisting of the —(OC3H6) groups is bound to a COO group, n is based on a molar average a number of from 44 to 46, m is based on a molar average 5, and a is based on a molar average a number of from 6 to 7.

7. Composition according to claim 6, characterized in that n based on a molar average is 45.

8. A composition according to claim 1 comprising at least 2 wt % alkoxylated polyethylene imine.

9. A composition according to claim 1 comprising at least 5 wt % anionic surfactant.

10. A composition according to claim 1 comprising Alkyl ether sulphate anionic surfactant.

11. A composition according to claim 1 comprising linear alkyl benzene sulfonate (LAS), the LAS being neutralised from LAS acid, at least in part, with triethanolamine (TEA).

12. A composition according to claim 1 comprising at least 2 wt % of the polyester.

13. A composition according to claim 1 comprising at least 0.5 wt % amine oxide.

14. A composition according to claim 1 comprising up to 25 wt % hydrotrope.

15. A composition according to claim 1 comprising at most 1 wt % alkali metal ions.

16. A composition according to claim 1 comprising less than 5 wt % soap.

17. A composition according to claim 16, comprising less than 3 wt % soap.

18. A composition according to claim 17, comprising less than 1 wt % soap.

* * * * *